United States Patent [19]

Grafen et al.

[11] Patent Number: 4,694,526

[45] Date of Patent: Sep. 22, 1987

[54] APPARATUS FOR HEAT TREATMENT OF A TEXTILE WEB

[75] Inventors: Karl Grafen; Theo Schiffers, both of Würselen, Fed. Rep. of Germany

[73] Assignee: H. Krantz GmbH & Co., Aachen, Fed. Rep. of Germany

[21] Appl. No.: 910,486

[22] Filed: Sep. 23, 1986

[30] Foreign Application Priority Data

Oct. 4, 1985 [DE] Fed. Rep. of Germany ..... 3535421

[51] Int. Cl.[4] ..... F26B 13/02

[52] U.S. Cl. ..... 15/306 A; 34/158; 68/5 D

[58] Field of Search ..... 15/306 R, 306 A, 316 R, 15/345; 34/158, 155; 68/5 D, 20

[56] References Cited

U.S. PATENT DOCUMENTS 2,022,593 11/1935 Fuykers ..... 15/345 X
3,015,893 1/1962 McCreary ..... 34/158
3,060,594 10/1962 Meier-Windhorst ..... 34/158 X
4,094,077 6/1978 Schrader et al. ..... 34/158 X
4,498,250 2/1985 Gageur et al. ..... 15/306 A X
4,516,332 5/1985 Takaoka et al. ..... 34/158 X

*Primary Examiner*—Chris K. Moore
*Attorney, Agent, or Firm*—Arthur B. Colvin

[57] ABSTRACT

An apparatus for the treatment of a textile web supported on a tenter by contact with a heated treatment medium is disclosed. The apparatus includes a nozzle box or boxes having openings directed toward a fabric web to be treated. A by-pass opening is provided for conducting the treatment medium from the compression to the suction side of a circulating apparatus. The cross sectional area of the by-pass opening is substantially identical to the total of the cross sectional areas of the nozzles of the nozzle box, whereby the flow resistance of the treatment medium is independent to whether flow is through the nozzle openings or through the by-pass opening or some combination thereof.

8 Claims, 2 Drawing Figures

APPARATUS FOR HEAT TREATMENT OF A TEXTILE WEB

BACKGROUND OF THE INVENTION

1. Field of the Invention

This invention relates to an apparatus for the heat treatment of a textile web with a cycled, heated treatment medium which via nozzle boxes and nozzles connected thereto is guided onto the cloth. After impingement on the cloth, the treatment medium goes into a collecting space which is connected to the suction side of a ventilator. The compression side of the ventilator is in communication with a distribution space, whence the treatment medium passes via inlet openings completely or partially into the nozzle boxes or else via inlet openings partially or completely directly back into the collecting space. To this end, there are arranged adjacent to each other an inlet opening leading to the nozzle box and an inlet opening leading to the collecting space, and they are selectively closable to a common register.

2. The Prior Art

With such a device as known from DE-OS No. 33 36 331, it can be achieved that during cloth standstill the treatment medium does not come in contact with the cloth and that, therefore, the treatment medium can be maintained at the set temperature without harm to the cloth. During a stoppage, in fact, the inlet openings through which the treatment medium flows from the distribution space into the nozzle boxes, can be closed by the registers, which in this closed position clear the inlet openings leading to the collecting space. Thereby the treatment medium can be circulated in a short circuit loop, by-passing impingement on the cloth, so that during standstill, overdrying or overfixation of the cloth is avoidable.

In the known apparatus, each inlet opening through which the treatment medium passes partially or wholly directly from the distribution space back into the collecting space, corresponds to the size and form of the inlet opening through which the treatment medium passes from the distribution space into the respective nozzle box. This cross section adaptation of the inlet openings has the disadvantage that with every change of the register position the operating point of the ventilator is changed and, therefore, an optimum mode of operation of the ventilator cannot be maintained. In fact, if the inlet opening leading to the nozzle box is increasingly cleared, the flow resistance caused by the nozzle openings decreases, and it is completely eliminated when the register is in a position which completely closes the inlet opening to the nozzle box. In the short circuit loop, therefore, the ventilator operates against a minimum flow resistance. If, on the other hand, the inlet opening leading to the collecting space is increasingly closed and, consequently, the inlet opening leading to the nozzle box is increasingly cleared, the flow resistance caused by the nozzle openings increases, and it becomes fully effective when the register has assumed a position which completely closes the inlet opening to the collecting space. In normal circulation, therefore, the ventilator operates against a maximum flow resistance.

SUMMARY OF THE INVENTION

It is the object of the invention to improve an apparatus of the initially described kind in such a way that the ventilator will, for any register position, circulate the same volume of treatment medium and, thus, can operate constantly at the optimum operating point.

Central to the solution of the above described drawbacks of the prior art is the provision of a treatment apparatus wherein the cross sectional area of the by-pass openings for shunting treatment medium from the compression to the suction sides of the device corresponds substantially exactly to the total of the cross sectional area of the treatment nozzles.

Due to the equality, according to the invention, of the free cross section of the inlet opening leading to the collecting space with the cross section sum of all nozzle openings of the respective nozzle box, the flow resistance of the treatment remains constant independently of whether the volume of the treatment medium is guided completely via the normal loop or completely via the short circuit loop or partly via one or the other loop, so that the ventilator circulates the same volume and hence, always operates at the optimum operating point.

According to a variant of the invention, the free cross section of the inlet opening leading to the nozzle box is greater than the free cross section of the inlet opening leading to the collecting space.

By this design, it is ensured that in normal cycling operation it is the cross section sum of the nozzle openings and, in short circuit cycle, the cross section (identical with this cross section sum of the inlet opening) leading to the collecting space, that form the only throttle points essentially determining the flow resistance.

According to additional variants of the invention, the plane of the inlet opening leading to the nozzle box and the plane of the inlet opening leading to the collecting space enclose an angle of 45°, and the plane of the inlet opening leading to the nozzle box encloses with the longitudinal axis of the nozzle box an angle also of 45°.

By these designs according to the invention, each register is arranged under 45° in the closing position of the inlet opening leading to the nozzle box, whereby it is achieved that over the entire swivel range of the register the free flow cross section is approximately proportional to the swivel angle of the register.

Preferably, each register has a position regulator assigned to it, by which the register can be pivoted continuously.

The pneumatic or hydraulic position regulator which permits continuous positioning of the register can be actuated via a control pressure line, to which a pressure gauge is connected. Thus, the register position is proportional to the pressure in the control line.

For bringing the registers, in case of cloth standstill, into a position which closes the inlet openings leading to the nozzle boxes and, upon resumed start-up, bringing the registers back to the throttle position last set prior to the standstill, a variant of the invention lastly provides that there is connected to the control pressure line a shutoff valve which can be actuated as a function of the movement of the textile web.

BRIEF DESCRIPTION OF DRAWING

In the drawing, an embodiment of the apparatus of the invention is illustrated.

DESCRIPTION OF PREFERRED EMBODIMENTS

The apparatus consists of a tenter enclosed by a housing 1. A textile web 2 is held stretched widthwise by endlessly revolving tentering chains, not shown, and is guided horizontally through the housing 1.

Figure 1:
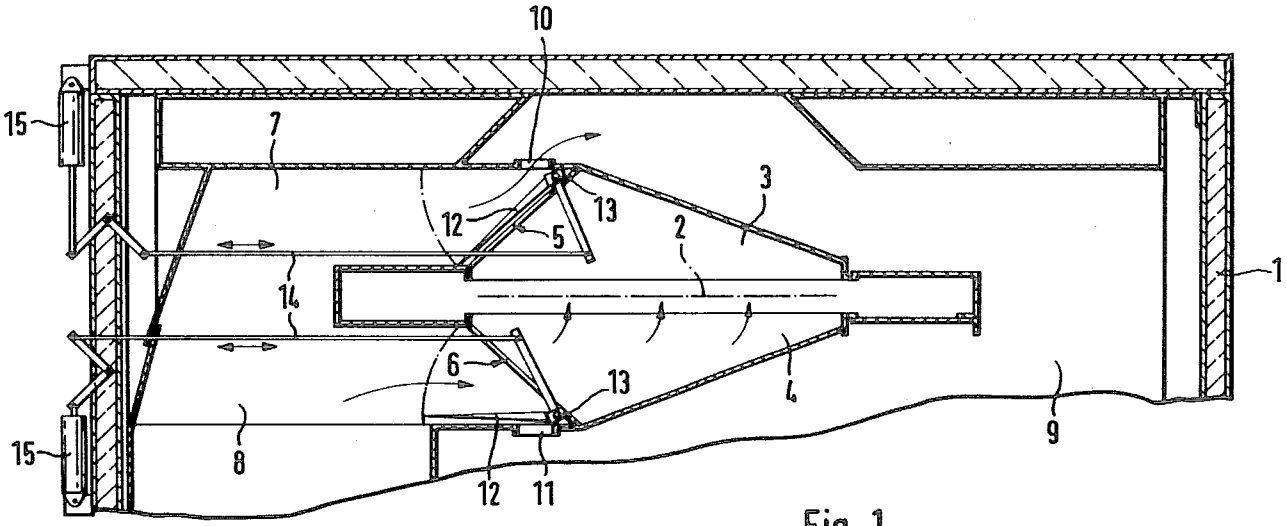
FIG. 1 shows a vertical partial transverse section through the apparatus.
Figure 2:
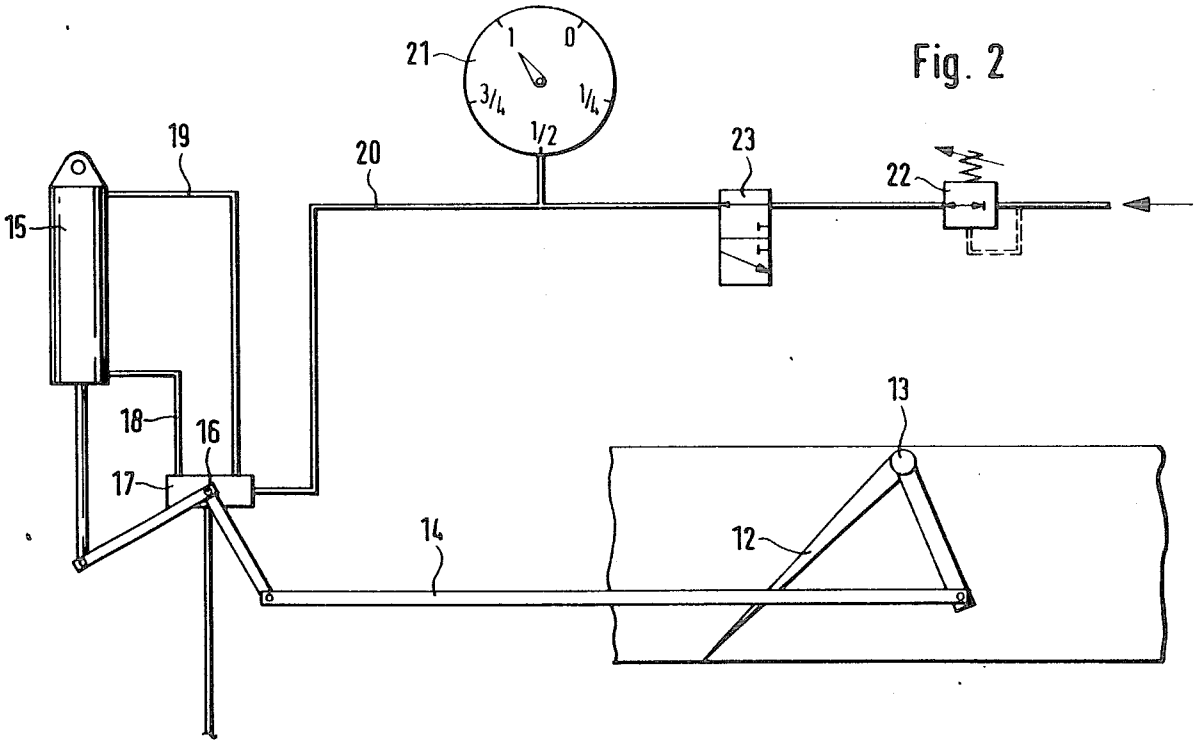
FIG. 2 shows a register with actuating linkage, on a larger scale than FIG. 1.

Over the length of the passage path of web 2, nozzle boxes 3 and 4 are arranged inside the housing 1 above and below web 2 extending over the width thereof; they have nozzle outlet openings (see arrows within nozzle box 4, FIG. 1), directed against the web 2, and laterally arranged inlet openings 5 and 6, respectively. The cross sectional planes of the inlet openings 5 and 6 extend at an angle of 45° to the web 2 running horizontally through the housing 1.

The inlet openings 5 and 6 connect a distribution space 7, 8 with the pressure side of a ventilator, not shown, whose suction side communicates with a collecting space 9, which surrounds the nozzle boxes 3 and 4 with the web 2 conducted between them.

Heated treatment medium can be conducted through the ventilator via the distribution spaces 7 and 8 into the nozzle boxes 3 and 4, and impinges via the nozzle outlet openings on the two sides of the textile web 2, and passes under lateral flow-off into the collecting space 9 to complete its cycle to the suction side of the ventilator.

Unlike the above described cycle conduction, the treatment medium can alternatively pass from the distribution spaces 7 and 8, by-passing the nozzle boxes 3 and 4, via inlet or by-pass openings 10, 11 directly into the collecting space 9 and, hence to the suction side of the ventilator, thus closing a partial cycle, without change in the volume delivered by the ventilator as compared with the above described cycle, since the cross section of the inlet openings 10 and 11 is arranged to be substantially identical to the cross section sum of the areas of nozzle outlet openings of the nozzle boxes 3, 4, respectively.

The inlet openings 5 and 10, as well as 6 and 11, are arranged adjacent to each other in such a way that they are selectively closable by a register 12 pivotable about 45°, although the inlet openings 5 and 6 have a much larger cross section than the inlet openings 10 and 11 which, as noted, are adapted to the cross section sum of the nozzle outlet openings.

The pivoting of the registers 12 about an axis 13 between the inlet openings 5 and 10, or respectively 6 and 11, occurs via a linkage 14 for each on which acts a pneumatic cylinder-piston rod unit 15.

On the axis of rotation 16 of linkage 14, a pneumatic position regulator 17 is arranged which via lines 18 and 19 is connected with the cylinder-piston rod unit 15 and permits continuous positioning of the register 12.

Further, there is conneced to the position regulator 17, via a control pressure line 20, a pressure gauge 21 with which the particular position of register 12 can be indicated. The control pressure line 20 leads to a pressure reducer 22, by the adjustment of which the position of register 12 can be changed proportionally.

From a compressed air source, not shown, to the pressure reducer 22, the control pressure line 20 leads via a shutoff valve 23, which is automatically closed upon standstill of the chains passing through the tenter and is opened again upon re-start, so that during standstill of web 2 the control pressure is cut off and the register 12 are biased to shut off the inlet openings 5 and 6 leading to the nozzle boxes 3 and 4 but leave the inlet openings 10 and 11 leading to the collecting space 9 open.

Each position of register 12 corresponds to a control pressure, available at the position regulator 17. If, for example, the control pressure is 0 bar, the registers 12 are in a position closing the inlet openings 5 and 6. At a control pressure of 0.25 bar or 0.50 bar or 0.75 bar, the inlet openings 5 and 6 may, for example, be free by $\frac{1}{4}$ or $\frac{1}{2}$ or $\frac{3}{4}$ their cross section, and at a control pressure of 1 bar, completely free. The control pressure is present only at the position regulator 17, while before and behind the piston of the cylinder-piston rod unit 15, an operating pressure of, for example, up to 6 bars may be available. If the cylinder-piston rod unit 15 is displaced by a variation of the control pressure, the position regulator 17 vents the cylinder on one side, and the piston moves until the position corresponding to the control pressure is reached.

What is claimed as new and sought to be protected by Letters Patent of the United States is as follows:

1. In an apparatus for the treatment of a textile web supported on a tenter with a heated treatment medium, said apparatus including ventilator means having a suction and compression side, a distribution space connected to said compression side, a collection space connected to said suction side, and a nozzle box vented to said collection space, said nozzle box including treatment openings directed toward said web, the improvement which comprises a first inlet opening leading from said distribution space into said nozzle box, a by-pass opening leading from said distribution space into said collection space, the cross sectional area of said by-pass opening being substantially equal to the combined cross sectional areas of said treatment openings, said inlet opening being disposed adjacent said by-pass opening, and a common register member movably mounted adjacent said inlet and by-pass openings and adapted to be shifted alternatively into closing position of one or the other of said openings.

2. Apparatus in accordance with claim 1, wherein the cross sectional area of said inlet opening exceeds the cross sectional area of said by-pass opening.

3. Apparatus in accordance with claim 2, wherein said inlet and by-pass openings are disposed in angularly offset planes passing through a common axis and said register member is mounted for pivotal movement about said axis.

4. Apparatus in accordance with claim 3, wherein the planes of said inlet and by-pass openings enclose an angle of substantially 45°.

5. Apparatus in accordance with claim 4, wherein the plane of said inlet opening is disposed at an angle of substantially 45° relative to the longitudinal axis of said nozzle box.

6. Apparatus in accordance with claim 1, wherein said inlet and by-pass openings are disposed in angularly offset planes passing through a common axis, said register member is mounted for pivotal movement about said axis, position regulator means including a piston and cylinder operatively connected to said register for pivoting said register between limiting positions selectively closing said inlet or by-pass opening, an variable pressure regulator means operatively associated with said cylinder for regulating the position of said piston and, hence, said register in accordance with the pressure applied to said cylinder.

7. Apparatus in accordance with claim 6 and including pressure gauge means for sensing the pressure to said cylinder and thereby providing an indication of the position of said register.

8. Apparatus in accordance with claim 6 and including shutoff valve means associated with said cylinder for interrupting flow to said cylinder, and means for activating said shutoff valve means responsive to sensation of movement of said tenter.

* * * * *